US006260845B1

(12) United States Patent
MacGowan, III

(10) Patent No.: US 6,260,845 B1
(45) Date of Patent: Jul. 17, 2001

(54) COACHING AND TASK ASSIGNMENT TOOL

(76) Inventor: John Malcolm MacGowan, III, 19775 Near Mountain Blvd., Shorewood, MN (US) 55331

( * ) Notice: Subject to any disclaimer, the term of this patent is extended or adjusted under 35 U.S.C. 154(b) by 0 days.

(21) Appl. No.: 09/251,006

(22) Filed: Feb. 16, 1999

(51) Int. Cl.[7] ..... A63F 11/00

(52) U.S. Cl. ..... 273/148 R; 273/142 R; 273/459; 283/115; 283/49; 283/65

(58) Field of Search ..... 273/142 R, 148 R, 273/459; 283/115, 49, 65; 116/225

(56) References Cited

U.S. PATENT DOCUMENTS

| | | | | |
|---|---|---|---|---|
| 2,907,123 | * | 10/1959 | McMahon | 273/142 R |
| 3,941,080 | | 3/1976 | Ford | 116/130 |
| 4,173,197 | | 11/1979 | Anker | 116/223 |
| 5,582,128 | * | 12/1996 | Wollan et al. | 116/225 |
| 5,938,198 | * | 8/1999 | Kostecki | 273/148 R |

* cited by examiner

*Primary Examiner*—Benjamin H. Layno
(74) *Attorney, Agent, or Firm*—Kinney & Lange, P.A.

(57) ABSTRACT

A tool is disclosed for providing multiple assignments of each of a plurality of players or participants to each of a plurality of positions or tasks in a sporting event, game or activity. The positions include playing positions and reserve positions. The tool comprises a base and a plurality of rotatable elements. Each player or participant representation represents one of the plurality of players or participants. Each rotatable element is divided into a unique number of sections. Each section of a rotatable element includes a position or task representation. Each rotatable element is rotatably mountable on the base such that each section of the rotatable element aligns with one of the plurality of player or participant representations on the base and thereby assigns each player or participant to a particular playing position, reserve position or task. New position or task assignments are obtained by rotating the rotatable element and aligning each player or participant representation with a new position or task representation.

29 Claims, 6 Drawing Sheets

40

FAIRTURN.COM™ Player Positioning Matrix ©
12 or fewer players on team
6 Playing Positions
3 Forwards, 2 Defense and Goal 42 44

NUMBER OF PLAYERS

PLAYER POSITION

46

| 12 | 11 | 10 | 9 | 8 | 7 | 6 |
|---|---|---|---|---|---|---|
| GOAL | GOAL | GOAL | GOAL | GOAL | GOAL | GOAL |
| OUT | CENTER | CENTER | CENTER | CENTER | CENTER | CENTER |
| CENTER | OUT | OUT | OUT | DEFENSE LEFT | DEFENSE LEFT | DEFENSE LEFT |
| OUT | DEFENSE LEFT | DEFENSE LEFT | DEFENSE LEFT | FORWARD LEFT | FORWARD LEFT | FORWARD LEFT |
| DEFENSE LEFT | OUT | FORWARD LEFT | FORWARD LEFT | OUT | DEFENSE RIGHT | DEFENSE RIGHT |
| OUT | FORWARD LEFT | OUT | OUT | DEFENSE RIGHT | FORWARD RIGHT | FORWARD RIGHT |
| FORWARD LEFT | OUT | DEFENSE RIGHT | DEFENSE RIGHT | FORWARD RIGHT | OUT | |
| OUT | DEFENSE RIGHT | OUT | FORWARD RIGHT | OUT | | |
| DEFENSE RIGHT | OUT | FORWARD RIGHT | OUT | | | |
| OUT | FORWARD RIGHT | OUT | | | | |
| FORWARD RIGHT | OUT | | | | | |
| OUT | | | | | | |
| | | | | | | |

48

FIG. 3

COACHING AND TASK ASSIGNMENT TOOL

CROSS-REFERENCE TO RELATED APPLICATION(S)

None.

BACKGROUND OF THE INVENTION

The present invention relates to a tool for assisting the coach of a sports team, or for assisting a group of individuals participating in a game or other activity. More specifically, the invention relates to a tool that provides for a fair rotation of players or participants among a plurality of positions or tasks in a sporting event, game or activity.

In recreational sports, such as soccer and baseball, there arc a fixed number of playing positions. In baseball there are nine playing positions, and in adult soccer, there are eleven playing positions. In many youth soccer leagues, there are from three to eight playing positions. Roster sizes vary from team to team, but almost always include more players than playing positions. Typically, in a sporting event in which children are involved, it is important to fairly move the children around among the various playing positions, and make certain that each child receives equal playing time. It is particularly difficult when dealing with younger children to coordinate their activities on the field, teach them how to play the game, while at the same time keeping track of who is playing which position and how long each child has been at each position. It is often impossible to prepare a set rotation of players and positions prior to game time, because the coach does not always know which players will show Lip, nor the total number of players that will show up.

The prior art has not adequately addressed the issue of assisting coaches in providing a fair rotation of players among a plurality of positions in a sporting event or game. The prior art only discloses devices for passively tracking the current playing position occupied by each player, but does not disclose a device that pro-actively instructs a coach which players are to occupy the various playing positions and which players are to occupy reserve positions (i.e., out or bench positions). For instance, U.S. Pat. No. 4,173,197 (the '197 patent), discloses a volleyball rotation counter. As shown in FIG. 1 of the '197 patent, the volleyball rotation counter 10 includes a frame 20 and two rotatable disks 40. Rotatable disks 40 have upper surfaces 48 capable of receiving visible, removable markings. Each disk 40 represents a different one of two teams playing volleyball. The two disks 40 arc separated by intermediate portion 170, which represents the volleyball net between the two teams. Each disk 40 includes six position spaces 140, representing the twelve playing positions on the volleyball court. In each position space 140, the umpire marks the number of the player who is in that playing position. The umpire then keeps track of the playing position occupied by each player by rotating the appropriate disk 40 in response to the players of a team rotating playing positions. The '197 patent discloses nothing about accommodating extra players that occupy reserve positions, and providing a rotation of players among playing positions and reserve positions.

Similarly, U.S. Pat. No. 3,941,080 (the '080 patent) discloses a game position monitoring device that merely keeps track of the playing position occupied by each member of a team. Referring to FIG. 1 of the '080 patent, the position monitoring device 10 includes a carrying member 12 adapted to receive either the names or uniform numbers of the various playing members of the team, or alternatively, the playing positions that are to be occupied in playing the game. The position monitoring device 10 also includes a rotatable clement 16 that includes spaces 18 for receiving the appropriate information, such as the names or uniform numbers of players, or the playing positions that are to be occupied in playing the game. As with the rotation counter disclosed in the '197 patent, the monitoring device in the '080 patent passively monitors which player is in which playing position, and does not actively assign players to positions, including playing positions and reserve positions.

BRIEF SUMMARY OF THE INVENTION

The coaching tool of the present invention provides advantages that are not realized in prior art devices. The coaching tool disclosed herein actively assigns players to positions, including playing positions and reserve positions, rather than passively monitoring which players are currently occupying the various playing positions.

The coaching tool comprises a base and a plurality of rotatable elements. The base is adapted to receive a plurality of player representations. Each player representation represents one of a plurality of players. Each rotatable element is divided into a unique number of sections. Each section of a rotatable element includes a position representation that represents a particular one of the plurality of positions. Each rotatable element is rotatably mountable on the base such that each section of the rotatable element aliens with one of the plurality of player representations on the base and thereby assigns each player to a particular playing position or to a reserve position. New position assignments are obtained by rotating the rotatable element and aligning each player representation with a new position representation.

In addition to pro-actively assigning players to playing positions and reserve positions, rather than passively monitoring and reacting to changes in playing position assignments as disclosed in the prior art, there are numerous other differences between the invention disclosed herein and the monitoring devices disclosed in the prior art. The differences will become evident in the following detailed description.

In an alternative embodiment, the invention includes a base and a plurality of rotatable elements, and provides a rotation of a plurality of participants among a plurality of tasks.

BRIEF DESCRIPTION OF THE DRAWINGS

FIG. 3 is a diagram of a player position matrix.

DETAILED DESCRIPTION OF PREFERRED EMBODIMENTS

The following description is provided primarily in the context of a youth soccer team having six playing positions.

The playing positions include three forwards, two defense and one goalie. Although the present invention is described in the context of a youth soccer team, the invention may be used in any sporting event, game or activity in which a fair assignment of players or participants to positions or tasks is desired.

Figure 1:
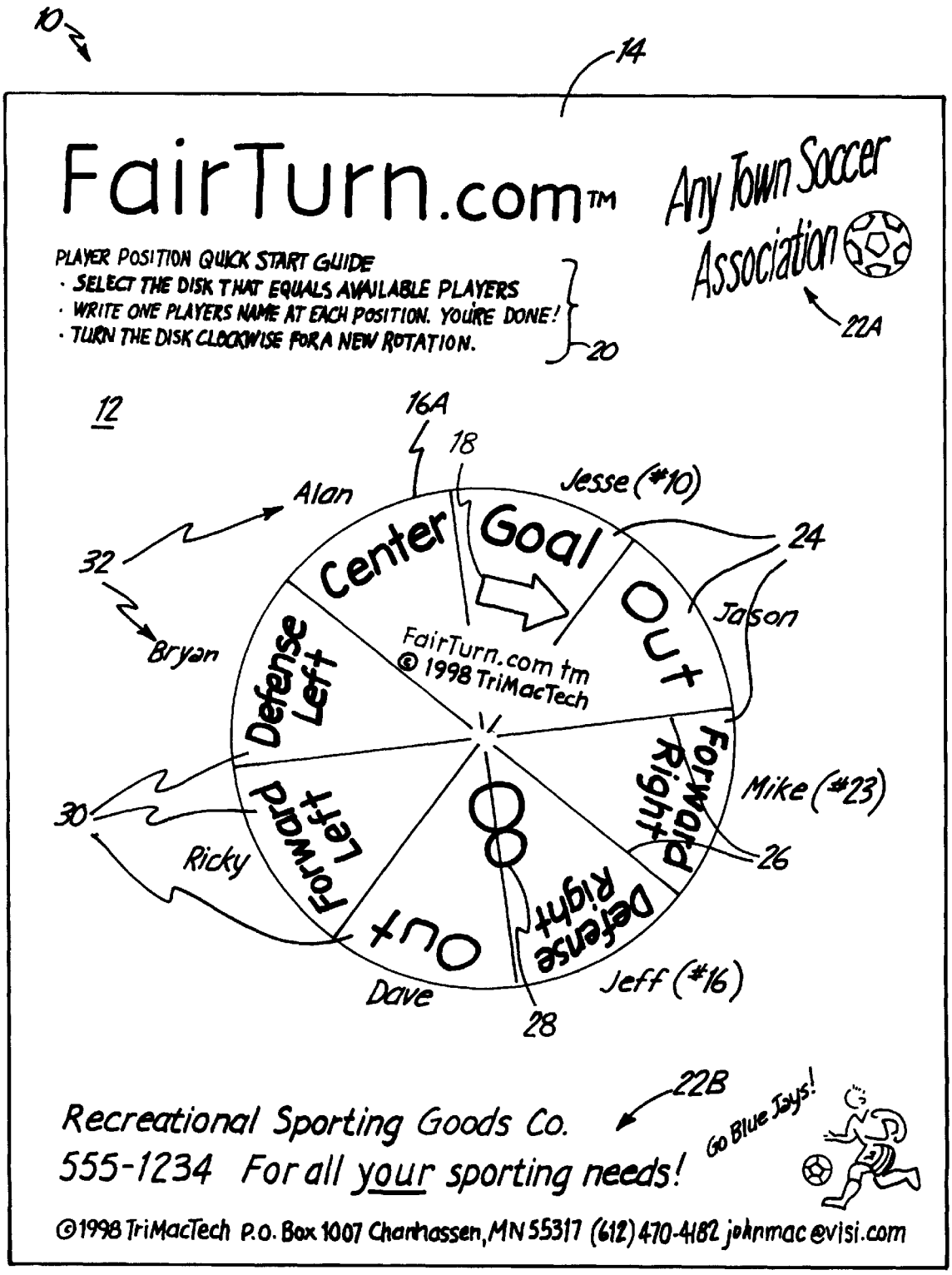
FIG. 1 is a top view of a preferred embodiment of a coaching tool according to the present invention.

FIG. 1 shows coaching tool 10. Coaching tool 10 includes base 12 and player position disk 16A. Note that in the following description, specific player position disks are referred to with the reference numeral "16" having an appended letter, whereas references to player position disks in general do not include the appended letter. As will be discussed in further detail below, each coaching tool 10 includes multiple player position disks 16, although only a single player position disk 16A is shown in FIG. 1. Player position disk 16A is rotatably mounted on top surface 14 of base 12, and is easily removable from base 12. Base 12 and player position disk 16A are preferably constricted from a durable, lightweight and inexpensive material, such as a plastic or cardboard, although other materials may be used. Base 12 is approximately eleven inches long, eight and a half inches wide and one sixteenth of an inch thick, while player position disk 16A is approximately four to five inches in diameter and approximately one sixteenth of an inch thick. Other dimensions may be used.

Player position disk 16A includes arrow 18, positions 24, dividers 26, position number indicator 28 and sectors 30. Sectors 30 are separated from one another by dividers 26, which begin at the center of player position disk 16A, extend radially outward, and end at the outer circumference of the disk. Each sector 30 is pre-marked with a position 24. Positions 24 include playing positions (e.g., goal, right forward, left defense), and reserve positions (e.g., "out"). Position number indicator 28 provides an indication of the number of sectors 30, and correspondingly the number of positions 24 on the player position disk. Arrow 18 indicates the direction that player position disk 16A is to be rotated during a game. Just prior to the start of a game, player representations 32 are written on the top surface 14 of base 12. The top surface 14 of base 12 preferably allows erasable markings to be made thereon. Player representations 32 may be player names, uniform numbers, both player names and uniform numbers or other markings that differentiate the various players.

Each coaching tool 10 includes multiple player position disks 16. Each player position disk 16 has a different position number indicator 28. Thus, virtually any number of positions can be accommodated. If eight players show up for a particular game, player position disk 16A (shown in FIG. 1) would be selected and mounted on base 12. On the other hand, if an additional player shows up just prior to game time, making nine total players, player position disk 16B (shown in FIG. 2) having nine sectors 30 would be chosen and mounted on base 12. After the appropriate player position disk 16 is selected and mounted on base 12, the name or uniform number of each player is written on base 12 next to one of the positions 24. At regular intervals (e.g., every 5 minutes), player position disk 16 is rotated in the direction indicated by arrow 18. Thus, the player in the goalie position (Jesse) would become the center, and one of the players who was sitting out (Jason) would become the goalie, etc. In alternative embodiments, player representations 32 and positions 24 are switched, so that player representations 32 appear on player position disks 16, while positions 24 appear on base 12.

Coaching tool 10 further includes instructions 20 and advertisements 22A and 22B. Instructions 20 provide guidance to a player or coach on the proper operation of the coaching tool. Advertisements 22A and 22B are easily added to coaching tool 10 to promote various products and services.

Figure 2:
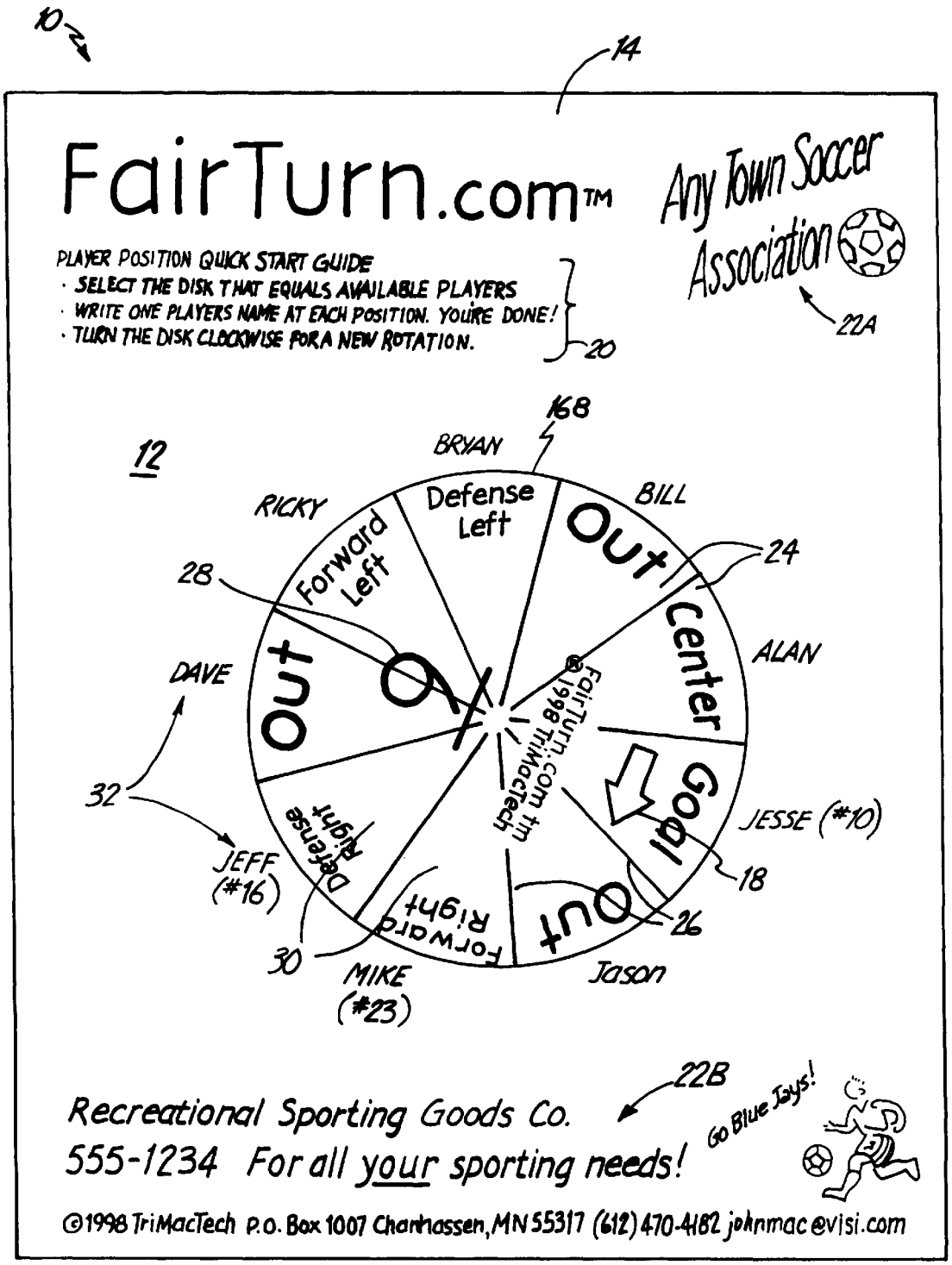
FIG. 2 is a top view of the coaching tool shown in FIG. 1, but with a different player position disk.

FIG. 2 shows coaching tool 10 with player position disk 16B rotatably mounted thereon. Player position disk 16B is the same as player position disk 16A shown in FIG. 1, but includes nine sectors 30 and positions 24 rather than eight. Position number indicator 28 provides an easily noticeable indication that there are nine positions 24 on player position disk 16B.

As with player position disk 16A shown in FIG. 1, player position disk 16B shown in FIG. 2 is removable to allow a different player position disk 16 having a different number of positions 24 to be mounted on the base. The proper player position disk 16 is selected based on the number of players that show up for a given game.

In an alternative embodiment, the number of player position disks 16 for a given coaching tool 10 is limited by printing on both sides of the player position disks. Thus, for example, player positions disks 16A and 16B could be made into a single player position disk by printing the information from disk 16A onto the back side of disk 16B.

In further alternative embodiments, player position disks 16 are permanently, rotatably mounted on base 12. For example, player position disk 16A could be permanently, rotatably mounted on the top surface 14 of base 12, and player position disk 16B could be permanently mounted on a bottom surface of base 12. In such an embodiment, additional bases 12 having additional player position disks 16 would be desirable to accommodate more team sizes.

FIG. 3 shows player position matrix 40. Player position matrix 40 consists of a plurality of columns 44 and a plurality of rows 46. At the intersection of each column 44 and row 46 is a position entry 48. Player position matrix 40 provides a preferred rotation of positions for various numbers of players. At the top of each column 44, a heading 42 is provided that indicates the number of player positions in that column. Each position entry 48 under a heading 42 corresponds to one of the pre-marked positions 24 on a player position disk 16. Each column 44 corresponds to one player position disk 16, and indicates how the positions 24 should be arranged on the player position disk. Since there are seven columns in player position matrix 40, with the number of players ranging from six to twelve, there are also preferably seven player position disks 16 associated with each coaching tool 10, with the number of positions 24 also ranging from six to twelve. Other numbers of player position disks 16 may be used. Also, player position disks 16 with different numbers of positions and different rotations of positions may be used as well.

Figure 4:
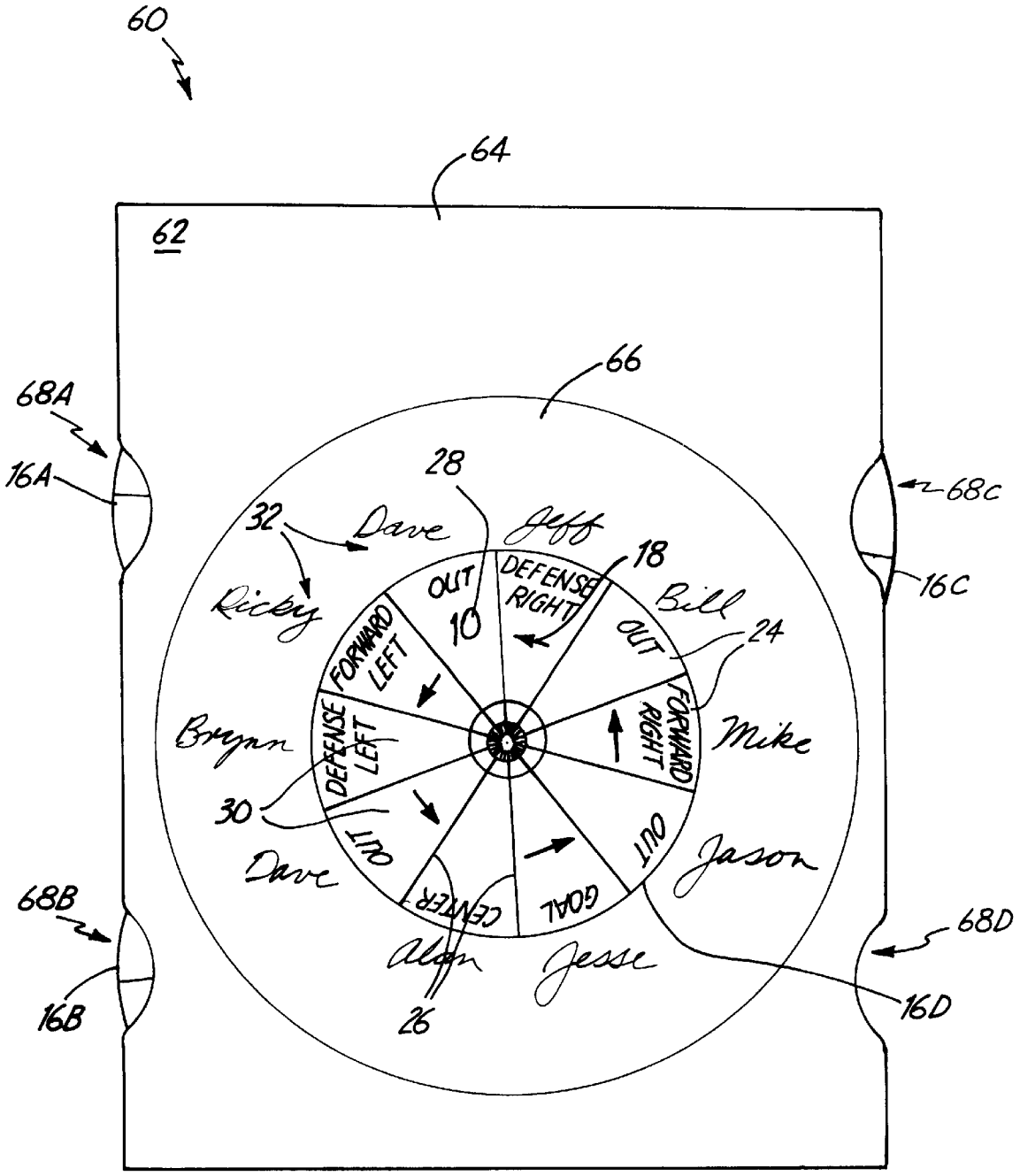
FIG. 4 is a top view of a preferred embodiment of a coaching tool with pockets for storing player position disks.

FIG. 4 shows coaching tool 60, which includes base 62, erasable surface 66, and player position disks 16A–16D. Base 62 and player position disks 16A–16D are preferably constricted from a durable, lightweight and inexpensive material, such as a plastic or cardboard, although other materials may be used. Player position disk 16D is shown rotatably mounted on base 62. Erasable surface 66 encircles player position disk 16D. Alternatively erasable surface 66 may encompass the entire top surface 64 of base 62, thereby allowing erasable markings to be made on the entire top surface of base 62. Base 62 includes four pockets 68A–68D (collectively referred to as pockets 68) formed therein. Each pocket 68 is adapted to receive one player position disk 16. Pockets 68 provide for easy storage and retrieval of the player position disks. Preferably, each player position disk 16 includes a different number for position number indicator 28, and correspondingly a different number of positions 24.

Coaching tool 60 operates in the same manner as the coaching tool shown in FIGS. 1 and 2. The appropriate player position disk 16 is chosen based on the number of players that show up for a given game. The player names or uniform numbers are then written on erasable surface 66 adjacent to positions 24. At periodic intervals, the player position disk 16 is rotated in the direction indicated by arrow 18, and the players move to their new position assignments as indicated by positions 24. If additional players join the game, or if a player has to leave the game early, a different player position disk 16 may be removed from one of the pockets 68 of base 62. The newly selected disk would then be mounted on base 62, and the process would be repeated.

Figure 5:
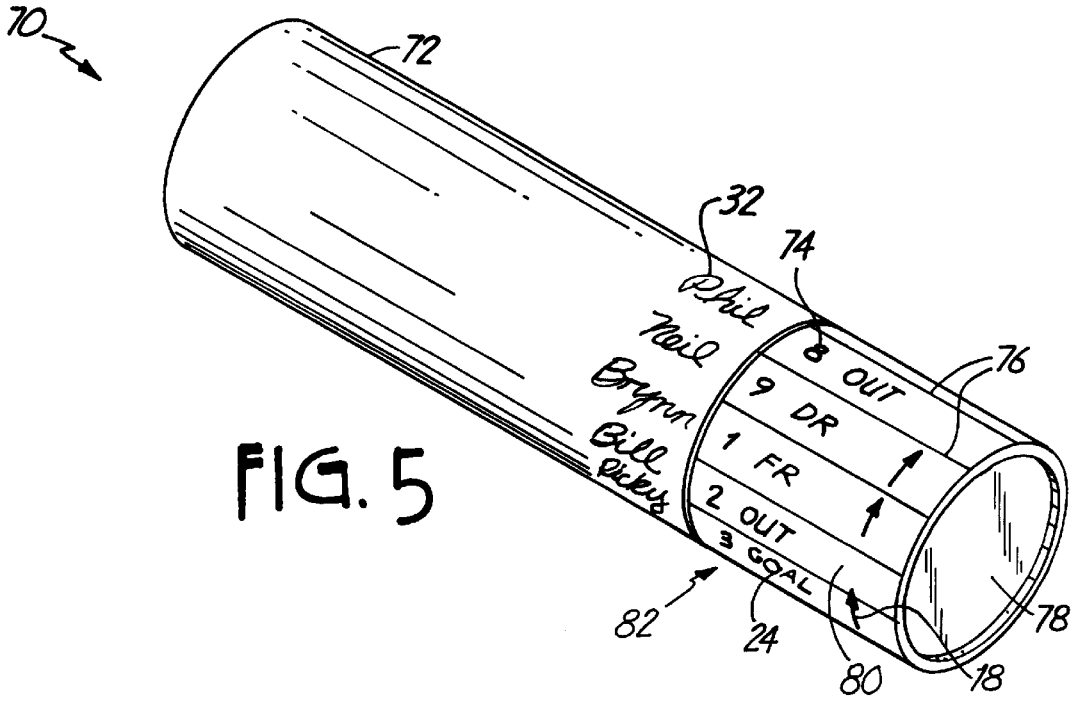
FIG. 5 is a perspective view of a preferred embodiment of a coaching tool with a cylindrical body.

FIG. 5 shows coaching tool 70. Coaching tool 70 includes cylindrical base 72 and cylindrical top 78. Cylindrical top 78 is rotatably mounted on cylindrical base 72. Cylindrical base 72 and cylindrical top 78 are preferably constructed from a durable, lightweight and inexpensive material, such as a plastic or cardboard, although other materials may be used. Coaching tool 70 is preferably about nine inches long and about two inches in diameter, so that it can easily be held in an individual's hand. The outer surface of cylindrical base 72 is preferably made from a material that allows erasable markings to be made thereon. Therefore, player representations 32 may easily be written on cylindrical base 72, erased and changed. Player position list 82 is wrapped around the outer surface of cylindrical top 78. Player position list 82 is preferably constructed from a rectangular sheet of paper that is wrapped around cylindrical top 7, and held in place by a rubber band, adhesive, or other similar temporary attachment means. Player position list 82 is divided into multiple sections 80. Each section 80 includes a position 24 and a position number 74. Sections 80 arc separated from one another by dividers 76. Arrows 18 appear on various portions of player position list 82. Coaching tool 70 includes multiple player position lists 82, each having a different number of sections 80 and positions 24.

As with the coaching tools shown in FIGS. 1, 2, and 4, the correct player position list 82 is selected based on the number of players that show up for a given game. When the appropriate player position list 82 is selected, it is wrapped around cylindrical top 78 and held in place by a rubber band or non-permanent adhesive. Player representations 32 are then written on cylindrical base 72 adjacent to position numbers 74. At periodic intervals during the game, cylindrical top 78 is twisted or rotated such that each player is assigned to a new position.

Figure 6:
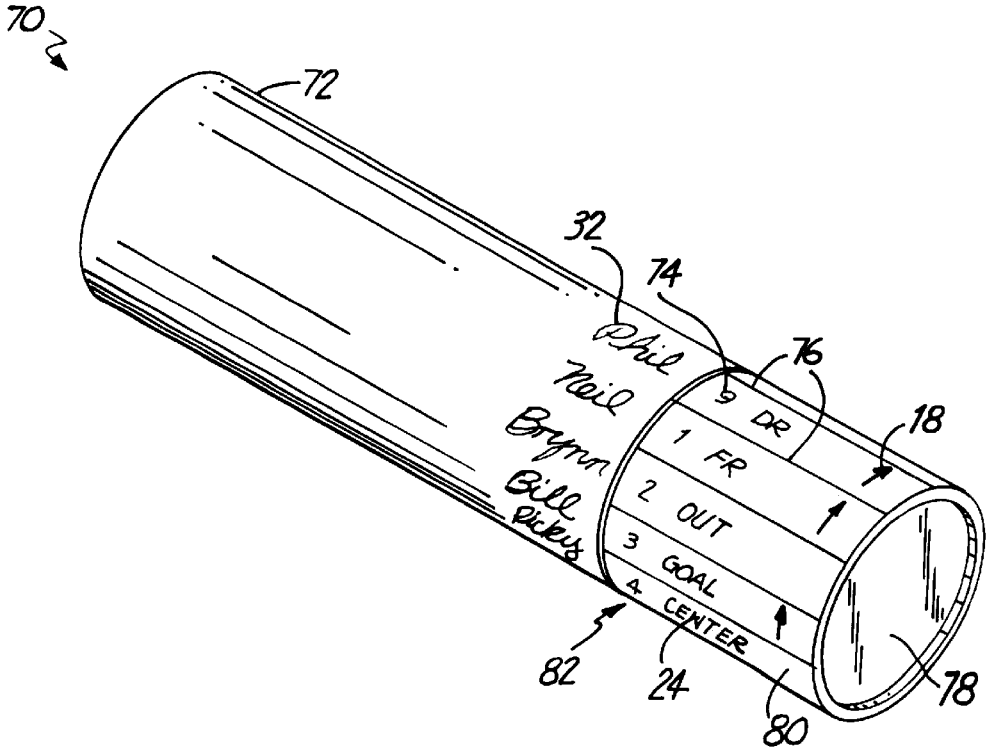
FIG. 6 is a perspective view of the coaching tool shown in FIG. 5, but with a different assignment of players to positions.

FIG. 6 shows coaching tool 70, which is the same as the coaching tool shown in FIG. 5, but cylindrical top 78 has been rotated a distance of one section in the direction indicated by arrows 18. Therefore, Neil, who was in a right defensive position (position "DR" as shown in FIG. 5) moves to a right forward position (position "FR" as shown in FIG. 6). Similarly, Phil, who was out of the game as indicated in FIG. 5, comes into the game in a right defensive position ("DR") as shown in FIG. 6.

Figure 7:
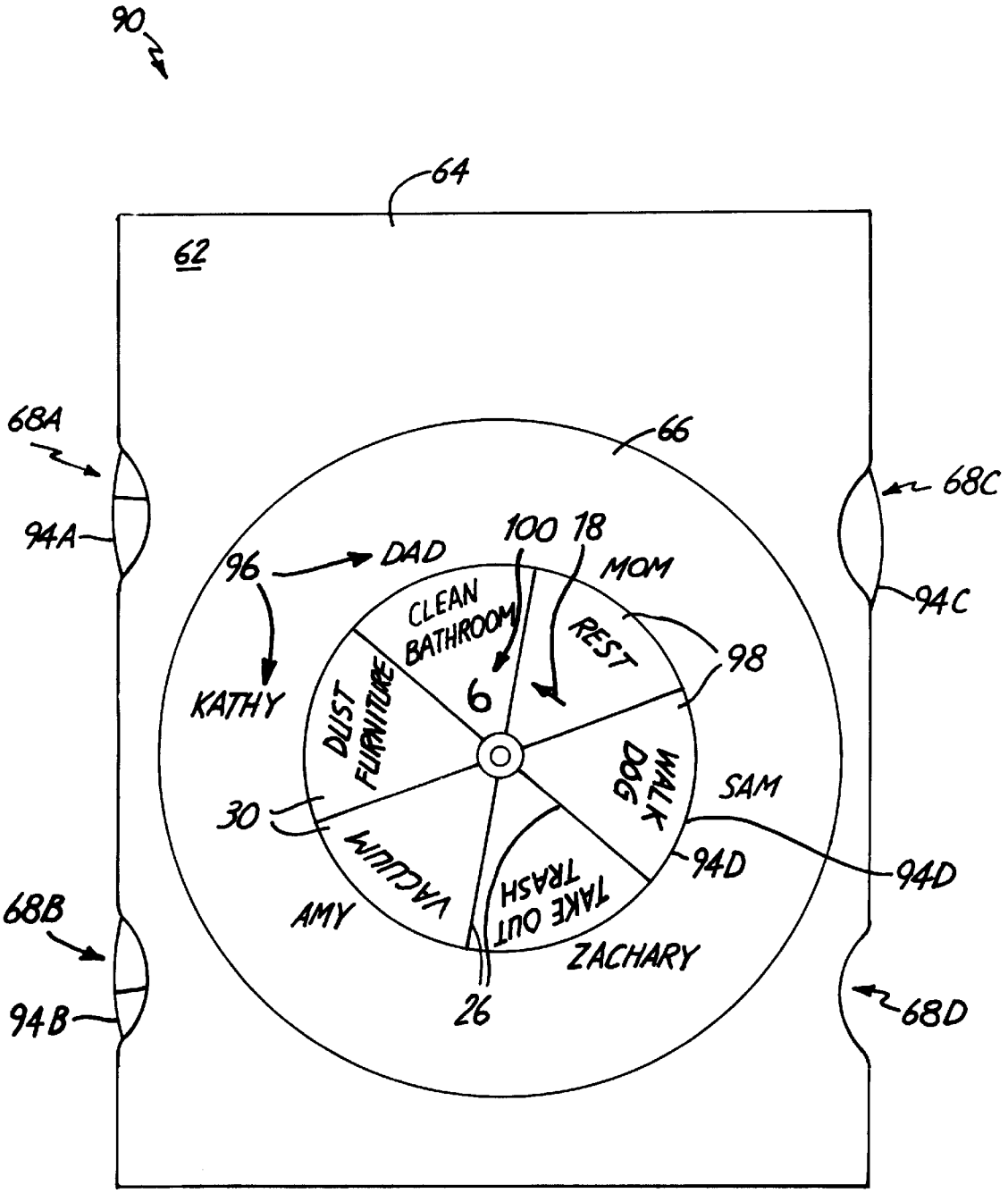
FIG. 7 is a top view of a preferred embodiment of a tool for providing a rotation of a plurality of participants among a plurality of tasks.

In addition to sporting events, games and related activities, the present invention may be used in other contexts as well. FIG. 7 illustrates one such application. FIG. 7 shows home chore tool 90, which is constructed in the same manner as the coaching tool shown in FIG. 4. Home chore tool 90 includes base 62, erasable surface 66 and home chore disks 94A–94D. Home chore disk 94D is shown rotatably mounted on top surface 64 of base 62. Home chore disks 94 include arrows 18, dividers 26 sectors 30, chore representations 98 and chore number indicator 100. Chore representations 98 include actual chores, such as vacuuming and dusting, and may also include one or more "rest" assignments, which indicate that no work is assigned for that period.

Erasable surface 66 encircles home chore disk 94D. Alternatively, erasable surface 66 may encompass the entire top surface 64 of base 62, thereby allowing erasable markings to be made on the entire top surface of base 62. Base 62 includes four pockets 68A–68D (collectively referred to as pockets 68) formed therein. Each pocket 68 is adapted to receive one home chore disk 94. Pockets 68 provide for easy storage and retrieval of the home chore disks.

Home chore tool 90 is operated in the same manner as the coaching tools described above. One of the home chore disks 94 is selected and rotatably mounted on top surface 64 of base 62. Family member representations 96 are written on erasable surface 66 next to chore representations 98. Home chore disk 94D is periodically rotated in the direction indicated by arrows 18, thereby providing a new assignment of chores to individual family members.

Multiple home chore disks 94 arc preferably used in each home chore tool 90 to accommodate various numbers of chores and eligible family members. For example, the number of chores may increase in some weeks, and decrease in other weeks. Likewise, the number of eligible family members may change from week to week (e.g., certain family members may be out of town for an extended period of time, certain family members may be rewarded for doing well in school by having their names removed from the home chore tool for a week, or certain family members may be punished by having their name written down multiple times on the home chore tool).

Although the present invention has been described with reference to preferred embodiments, workers skilled in the art will recognize that changes may be made in form and detail without departing from the spirit and scope of the invention.

What is claimed is:

1. A coaching tool for providing multiple assignments of each of a plurality of players to each of a plurality of positions in a sporting event, game or activity, the positions including playing positions and reserve positions, where players outnumber playing positions, the coaching, tool comprising:

a base adapted to receive a plurality of player representations, each player representation representing one of the plurality of players; and a plurality of rotatable elements each usable for a different number of players present, each rotatable element divided into a unique number of sections representing the number of players present when that rotatable element is used, each section of a rotatable element including a position representation that represents a particular one of the plurality of positions, each rotatable element rotatably mountable on the base such that each section of the rotatable element aligns with one of the plurality of player representations on the base and thereby assigns each player to a particular playing position or to a reserve position.

2. The coaching of claim 1 wherein the base is flat and generally rectangular in shape.

3. The coaching of claim 1 wherein the base includes a plurality of pockets, each pocket adapted to receive and store a rotatable element.

4. The coaching of claim 1 wherein the base includes an erasable surface for receiving the plurality of player representations.

5. The coaching of claim 1 wherein the player representations are names of players.

6. The coaching of claim 1 wherein the player representations are uniform numbers of players.

7. The coaching of claim 1 wherein the rotatable elements are circular disks.

8. The coaching of claim 1 wherein the base is cylindrical in shape.

9. The coaching tool of claim 1 wherein at least one of the rotatable elements is cylindrical in shape.

10. The coaching tool of claim 1 wherein at least one of the rotatable elements includes a number that indicates the number of sections on the rotatable element.

11. The coaching tool of claim 1 wherein at least one of the rotatable elements includes an arrow indicating a preferred direction of rotation for the rotatable element.

12. The coaching tool of claim 1 wherein at least one of the rotatable elements includes two sides, and both sides include position representations.

13. The coaching tool of claim 1 wherein the base includes two sides, and the rotatable elements are rotatably mountable on both sides of the base.

14. The coaching of claim 1 wherein the base includes a top side and bottom side, and a first rotatable element is permanently and rotatably mounted on the top side of the base, and a second rotatable element is permanently rotatably mounted on the bottom side of the base.

15. A method of providing a rotation of players among a plurality of positions in a sporting event, game or activity, the positions including playing positions and reserve positions, where players outnumber playing positions, the method comprising:

providing a base adapted to receive a plurality of player representations;

providing a plurality of rotatable elements each usable for a different number of players present, each rotatable element divided into a unique number of sections representing the number of players present when that rotatable element is used, each section of a rotatable element including a position representation that represents a particular one of the plurality of positions;

rotatably mounting a first rotatable element on the base;

adding a plurality of player representations to the base, each player representation aligned with one of the sections of the first rotatable element so as to provide an initial assignment of players to playing positions and reserve positions; and rotating the first rotatable element such that each section of the first rotatable element is aligned with a different one of the player representations on the base, thereby providing a second assignment of players to playing positions and reserve positions.

16. The method of claim 15 wherein the base is flat and generally rectangular in shape.

17. The method of claim 15 wherein the base includes a plurality of pockets, each pocket adapted to receive and store a rotatable element.

18. The method of claim 15 wherein the base includes an erasable surface for receiving the plurality of player representations.

19. The method of claim 15 wherein the player representations are names of players.

20. The method of claim 15 wherein the player representations are uniform numbers of players.

21. The method of claim 15 wherein the rotatable elements are circular disks.

22. The method of claim 15 wherein the base is cylindrical in shape.

23. The method of claim 15 wherein at least one of the rotatable elements is cylindrical in shape.

24. The method of claim 15 wherein at least one of the rotatable elements includes a number that indicates the number of sections on the rotatable element.

25. The method of claim 15 wherein at least one of the rotatable elements includes an arrow indicating a preferred direction of rotation for the rotatable element.

26. The method of claim 15 wherein at least one of the rotatable elements includes two sides, and both sides include position representations.

27. The method of claim 15 wherein the base includes two sides, and the rotatable elements are rotatably mountable on both sides of the base.

28. A task assignment device for providing a rotation of plurality of participants among a plurality of tasks when the participants outnumber the tasks, the device comprising:

a base adapted to receive a plurality of participant representations, each participant representation representing one of the plurality of participants; and a plurality of rotatable elements, each rotatable element divided into a unique number of sections which equal a particular number of participants, each section of a rotatable element including a task representation that represents one of the plurality of tasks, each rotatable element rotatably mounted on the base such that each section of the rotatable element aligns with one of the plurality of participant representations on the base and thereby assigns each participant to a particular task, each rotatable element including at least one a task representation that represents a rest assignment, indicating that no task is assigned.

29. A method of providing a rotation of participants among a plurality of tasks when the participants outnumber the tasks, the method comprising:

providing a base adapted to receive a plurality of participant representations;

providing a plurality of rotatable elements, each rotatable element divided into a unique number of sections which equal a particular number of participants, each section of a rotatable element including a task representation that represents a particular one of the plurality of tasks, each rotatable element including at least one task representation that represents a rest assignment, indicating that no task is assigned;

rotatably mounting a first rotatable element on the base;

adding a plurality of participant representations to the base, each participant representation aligned with one of the sections of the first rotatable element so as to provide an initial assignment of participants to task; and rotating the first rotatable element such that each section of the first rotatable element is aligned with a different one of the participant representations on the base, thereby providing a second assignment of participants to tasks.

* * * * *

UNITED STATES PATENT AND TRADEMARK OFFICE

CERTIFICATE OF CORRECTION

PATENT NO. : 6,260,845 B1
DATED : July 17, 2001
INVENTOR(S) : John Malcolm MacGowan III.

It is certified that error appears in the above-identified patent and that said Letters Patent is hereby corrected as shown below:

Column 1,
Lines 16 and 48, delete “arc”, insert -- are --
Line 32, delete “Lip”, insert -- up --
Line 39, after “positions”, insert -- , --

Column 2,
Line 2, delete “clement”, insert -- element --
Line 27, delete “aliens”, insert -- aligns --

Column 3,
Line 18, delete “constricted”, insert -- constructed --

Column 5,
Line 31, delete “7,”, insert -- 78 --
Line 35, delete “arc”, insert -- are --

Column 6,
Line 1, after “26”, insert -- , --
Line 23, delete “arc”, insert -- are --
Line 45, after “coaching,”, delete “,”
Lines 62 and 64, after “coaching”, insert -- tool --

Column 7,
Lines 1, 4, 6, 8, 10 and 26, after “coaching”, insert -- tool --
Line 27, before “bottom” insert -- a --
Line 29, after “permanently” insert -- and --

UNITED STATES PATENT AND TRADEMARK OFFICE

CERTIFICATE OF CORRECTION

PATENT NO. : 6,260,845 B1 
DATED : July 17, 2001
INVENTOR(S) : John Malcolm MacGowan III.

It is certified that error appears in the above-identified patent and that said Letters Patent is hereby corrected as shown below:

Column 8,
Line 21, after "of", insert -- a --
Line 32, delete "mounted", insert -- mountable --
Line 36, after "one", delete "a"
Line 56, delete "task", insert -- tasks --

Signed and Sealed this

Sixteenth Day of July, 2002

*Attest:*

*Attesting Officer*

JAMES E. ROGAN
*Director of the United States Patent and Trademark Office*